US010429784B2

(12) United States Patent
Nagata et al.

(10) Patent No.: US 10,429,784 B2
(45) Date of Patent: Oct. 1, 2019

(54) FIXING DEVICE AND IMAGE FORMING APPARATUS

(71) Applicant: FUJI XEROX CO., LTD., Tokyo (JP)

(72) Inventors: Yasushi Nagata, Kanagawa (JP); Sou Morizaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/120,456

(22) Filed: Sep. 4, 2018

(65) Prior Publication Data

US 2019/0227467 A1 Jul. 25, 2019

(30) Foreign Application Priority Data

Jan. 24, 2018 (JP) ..... 2018-009590

(51) Int. Cl.
*G03G 15/20* (2006.01)

(52) U.S. Cl.
CPC ..... *G03G 15/2053* (2013.01); *G03G 15/2064* (2013.01)

(58) Field of Classification Search
USPC ..... 399/328
See application file for complete search history.

(56) References Cited

U.S. PATENT DOCUMENTS

2011/0129267 A1* 6/2011 Arimoto ..... G03G 15/2053 399/329
2013/0183070 A1* 7/2013 Kawata ..... G03G 15/2053 399/329

FOREIGN PATENT DOCUMENTS

JP 2010181860 8/2010
JP 2012128074 A * 7/2012 ..... G03G 15/2053
JP 2013186192 9/2013

* cited by examiner

*Primary Examiner* — Quana Grainger
(74) *Attorney, Agent, or Firm* — JCIPRNET

(57) ABSTRACT

A fixing device includes an endless belt member that rotates, and includes a first end on one side in an axial direction and a second end on the other side in the axial direction; a belt support that comes into contact with part of an inner circumferential surface of the belt member to support an inner side of the belt member; a guide portion disposed on the inner side of the belt member at at least one of the first and second ends of the belt member to guide the belt member moving in a circumferential direction; and a protruding portion disposed at a position in the circumferential direction of the belt member different from a position in the circumferential direction at which the belt support is disposed, the protruding portion protruding from the guide portion toward the other one of the first and second ends of the belt member.

16 Claims, 11 Drawing Sheets

FIG. 5 (Priot Art)

FIXING DEVICE AND IMAGE FORMING APPARATUS

CROSS-REFERENCE TO RELATED APPLICATIONS

This application is based on and claims priority under 35 USC 119 from Japanese Patent Application No. 2018-009590 filed Jan. 24, 2018.

BACKGROUND

Technical Field

The present invention relates to a fixing device and an image forming apparatus.

SUMMARY

According to an aspect of the invention, a fixing device includes an endless belt member that rotates, and includes a first end on one side in an axial direction and a second end on the other side in the axial direction; a belt support that comes into contact with part of an inner circumferential surface of the belt member to support an inner side of the belt member; a guide portion disposed on the inner side of the belt member at at least one of the first and second ends of the belt member to guide the belt member moving in a circumferential direction; and a protruding portion disposed at a position in the circumferential direction of the belt member different from a position in the circumferential direction at which the belt support is disposed, the protruding portion protruding from the guide portion toward the other one of the first and second ends of the belt member.

BRIEF DESCRIPTION OF THE DRAWINGS

Exemplary embodiments of the present invention will be described in detail based on the following figures, wherein.

DETAILED DESCRIPTION

Exemplary embodiments according to some aspects of the present invention are described below with reference to the attached drawings.

Figure 1:
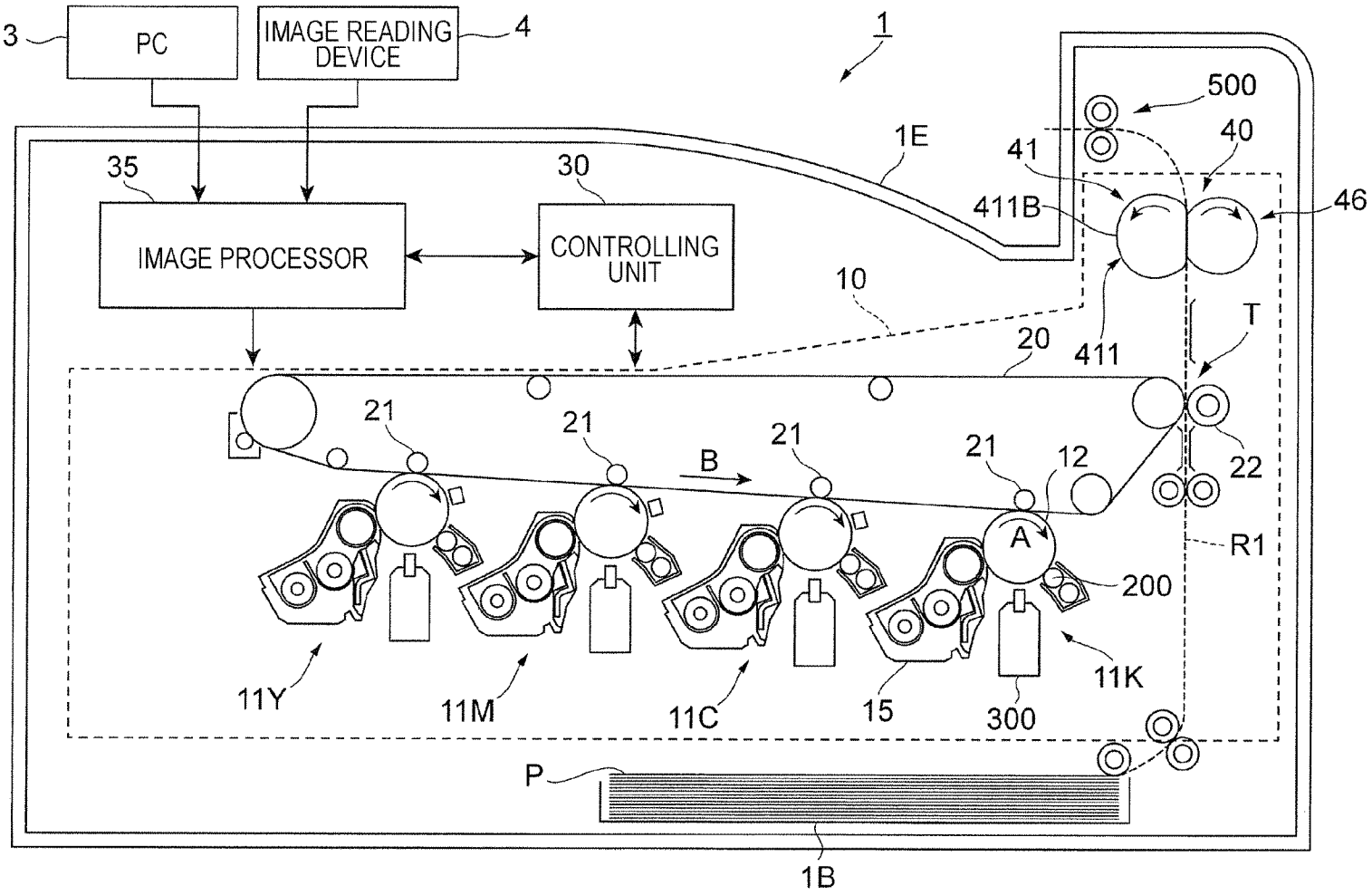
FIG. 1 illustrates an entire structure of an image forming apparatus.

FIG. 1 illustrates an entire structure of an image forming apparatus 1. Specifically, FIG. 1 illustrates the image forming apparatus 1 when viewed from the front side of the image forming apparatus 1.

The image forming apparatus 1 is a so-called tandem color printer.

The image forming apparatus 1 includes an image forming portion 10, which is an example of an image forming member. The image forming portion 10 forms images on sheets P, which are exemplary recording media, on the basis of image data for each color.

The image forming apparatus 1 also includes a controlling unit 30 and an image processor 35.

The controlling unit 30 controls functional portions of the image forming apparatus 1.

The image processor 35 performs image processing on the image data from, for example, a personal computer (PC) 3 or an image reading device 4.

An image forming portion 10 includes four image forming units 11Y, 11M, 11C, and 11K (also collectively simply referred to as "image forming units 11", below), arranged side by side at regular intervals.

The image forming units 11 have the same structure except for toner contained in respective developing devices 15 (described below). The respective image forming units 11 form yellow (Y), magenta (M), cyan (C), and black (K) toner images (images).

Each image forming unit 11 includes a photoconductor drum 12, a charging device 200, which charges the photoconductor drum 12 with electricity, and an LED print head (LPH) 300, which exposes the photoconductor drum 12 to light.

The photoconductor drum 12 is electrically charged by the charging device 200. The photoconductor drum 12 is exposed to light by the LPH 300 to have an electrostatic latent image formed thereon.

Each image forming unit 11 includes a developing device 15, which develops an electrostatic latent image formed on the photoconductor drum 12, and a cleaner (not illustrated) that cleans the surface of the photoconductor drum 12.

The image forming portion 10 includes an intermediate transfer belt 20, to which toner images of the respective colors formed by the photoconductor drums 12 are transferred, and first transfer rollers 21, which sequentially transfer (first-transfer) the toner images of the respective colors formed by the photoconductor drums 12 to the intermediate transfer belt 20.

The image forming portion 10 also includes a second transfer roller 22, which collectively transfers (second-transfers) the toner images transferred to the intermediate transfer belt 20 to a sheet P, and a fixing device 40, which fixes the toner images transferred to the sheet P onto the sheet P.

The fixing device 40 includes a fixing belt module 41, which includes a heat source, and a pressing roller 46.

The fixing belt module 41 is disposed on the left side of a sheet transport path R1 in the drawing. The pressing roller 46 is disposed on the right side of the sheet transport path R1 in the drawing. The pressing roller 46 is pressed against the fixing belt module 41.

The fixing belt module 41 includes a film-shaped fixing belt 411, which touches the sheet P.

The fixing belt 411, which is an example of a belt member, includes, for example, a separator layer disposed outermost to come into contact with the sheet P, an elastic layer disposed inside of and adjacent to the separator layer, and a base layer supporting the elastic layer. The fixing belt 411 is endless and rotates counterclockwise in the drawing.

The fixing belt 411 comes into contact with a sheet P transported thereto from below in the drawing. The portion of the fixing belt 411 in contact with the sheet P moves together with the sheet P. The fixing belt 411 holds the sheet P together with the pressing roller 46 to press and heat the sheet P.

The fixing belt module 41 also includes a heat source (described below), which heats the fixing belt 411, on the inner side of the fixing belt 411.

The pressing roller 46, which is an example of a pressing member, is disposed on the right side of the sheet transport path R1 in the drawing. The pressing roller 46 is pressed against an outer circumferential surface 411B of the fixing belt 411 to press the sheet P (sheet P passing along the sheet transport path R1) passing between the fixing belt 411 and the pressing roller 46.

The pressing roller 46 is rotated clockwise in the drawing by a motor (not illustrated). When the pressing roller 46 rotates clockwise, the fixing belt 411 rotates counterclockwise upon receipt of a driving force from the pressing roller 46.

In the image forming apparatus 1, the image processor 35 performs image processing on image data from the PC 3 or the image reading device 4, and feeds the image data subjected to image processing to the image forming units 11.

For example, in the image forming unit 11K for black (K), the photoconductor drum 12 is charged by the charging device 200 with electricity while rotating in the direction of arrow A, and exposed to light by the LPH 300 based on the image data transmitted from the image processor 35.

Thus, an electrostatic latent image corresponding to the image for black (K) is formed on the photoconductor drum 12. The electrostatic latent image on the photoconductor drum 12 is developed by the developing device 15 and formed into a toner image for black (K).

Similarly, yellow (Y), magenta (M), and cyan toner images are respectively formed by the image forming units 11Y, 11M, and 11C.

The toner images for respective colors formed by the respective image forming units 11 are sequentially electrostatically attracted to the intermediate transfer belt 20, moving in the direction of arrow B, by the first transfer rollers 21, and a toner image formed by superposing the toner of the respective colors is formed on the intermediate transfer belt 20.

The toner image formed on the intermediate transfer belt 20 is transported to a portion at which the second transfer roller 22 is located (second transfer portion T) with a movement of the intermediate transfer belt 20. At the timing where the toner image is transported to the second transfer portion T, a sheet P is fed to the second transfer portion T from a sheet container portion 1B.

At the second transfer portion T, the transfer electric field formed by the second transfer roller 22 collectively electrostatically transfers the toner image on the intermediate transfer belt 20 to the sheet P transported to the second transfer portion T.

Thereafter, the sheet P to which the toner image has been electrostatically transferred is separated from the intermediate transfer belt 20, and transported to the fixing device 40.

The fixing device 40 holds the sheet P with the fixing belt module 41 and the pressing roller 46. Specifically, the fixing device 40 holds the sheet P with the fixing belt 411, rotating counterclockwise, and the pressing roller 46, rotating clockwise.

Thus, the sheet P is pressed and heated so that the toner image on the sheet P is fixed to the sheet P. The sheet P subjected to fixing is transported to a sheet stack portion 1E by discharging rollers 500.

Figure 2:
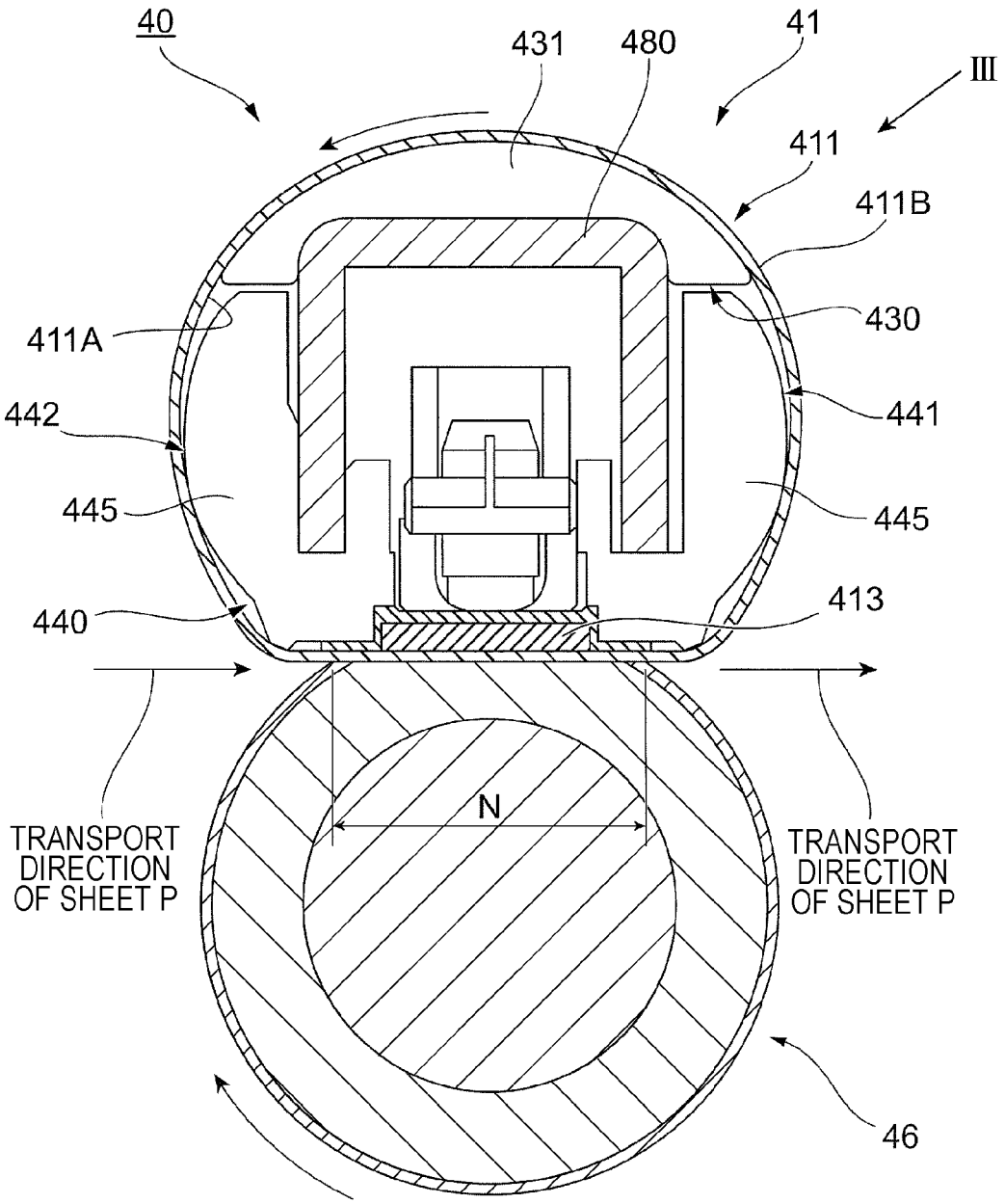
FIG. 2 illustrates a structure of a fixing device.

FIG. 2 illustrates a structure of the fixing device 40.

As illustrated in FIG. 2, the fixing device 40 includes the fixing belt module 41 and the pressing roller 46.

The fixing belt module 41 includes the fixing belt 411 used for fixing the toner image to a sheet P. The fixing belt 411 is pressed against a surface of the sheet P on which the toner image is formed.

The pressing roller 46, which is an example of a pressing member, is pressed against the outer circumferential surface 411B of the fixing belt 411, to press the sheet P passing between the fixing belt 411 and the pressing roller 46.

Specifically, the pressing roller 46 is disposed in contact with the outer circumferential surface 411B of the fixing belt 411. The pressing roller 46 forms, between itself and the fixing belt 411, a nip portion N (an example of a pressing area), which is an area through which the sheet P passes while being pressed.

In the present exemplary embodiment, while the sheet P passes through the nip portion N, the sheet P is heated and pressed to have the toner image fixed to the sheet P.

A heat source 413, which heats the fixing belt 411, is disposed on the inner side of the fixing belt 411.

The heat source 413 has a plate shape extending in a movement direction and a width direction of the fixing belt 411. In the present exemplary embodiment, the heat source 413 feeds heat to the fixing belt 411 to heat the fixing belt 411.

In the present exemplary embodiment, the pressing roller 46 is pressed against the heat source 413 with the fixing belt 411 interposed therebetween.

The fixing belt module 41 also includes a restricting member 430 (described in detail below), which restricts the fixing belt 411 from moving in the axial direction. The restricting member 430 includes a protruding portion 431, which protrudes in the axial direction of the fixing belt 411 (toward a second end portion of the fixing belt 411).

A belt support member 440, which supports the inner side of the fixing belt 411, is disposed on the inner side of the fixing belt 411. The belt support member 440 includes an upstream support assembly 441 and a downstream support assembly 442.

The upstream support assembly 441 is disposed upstream of the protruding portion 431 in the movement direction of the fixing belt 411. The downstream support assembly 442 is disposed downstream of the protruding portion 431 in the movement direction of the fixing belt 411.

The upstream support assembly 441 includes belt supports 445, which are in contact with part of an inner circumferential surface 411A of the fixing belt 411 to support the inner side of the fixing belt 411. In the present exemplary embodiment, the belt supports 445 are arranged in the axial direction of the fixing belt 411 to form the upstream support assembly 441.

The downstream support assembly 442 also includes belt supports 445, which are in contact with part of the inner circumferential surface 411A of the fixing belt 411 to support the inner side of the fixing belt 411.

In the exemplary embodiment, the belt supports 445 are arranged in the axial direction of the fixing belt 411 to form the downstream support assembly 442.

The fixing belt module 41 includes a support frame 480, which is an example of an internal member. The support frame 480 is disposed on the inner side of the fixing belt 411 to support the components disposed on the inner side of the fixing belt 411.

Specifically, the support frame 480 supports the components disposed on the inner side of the fixing belt 411, such as the belt support member 440 and the heat source 413.

Figure 3:
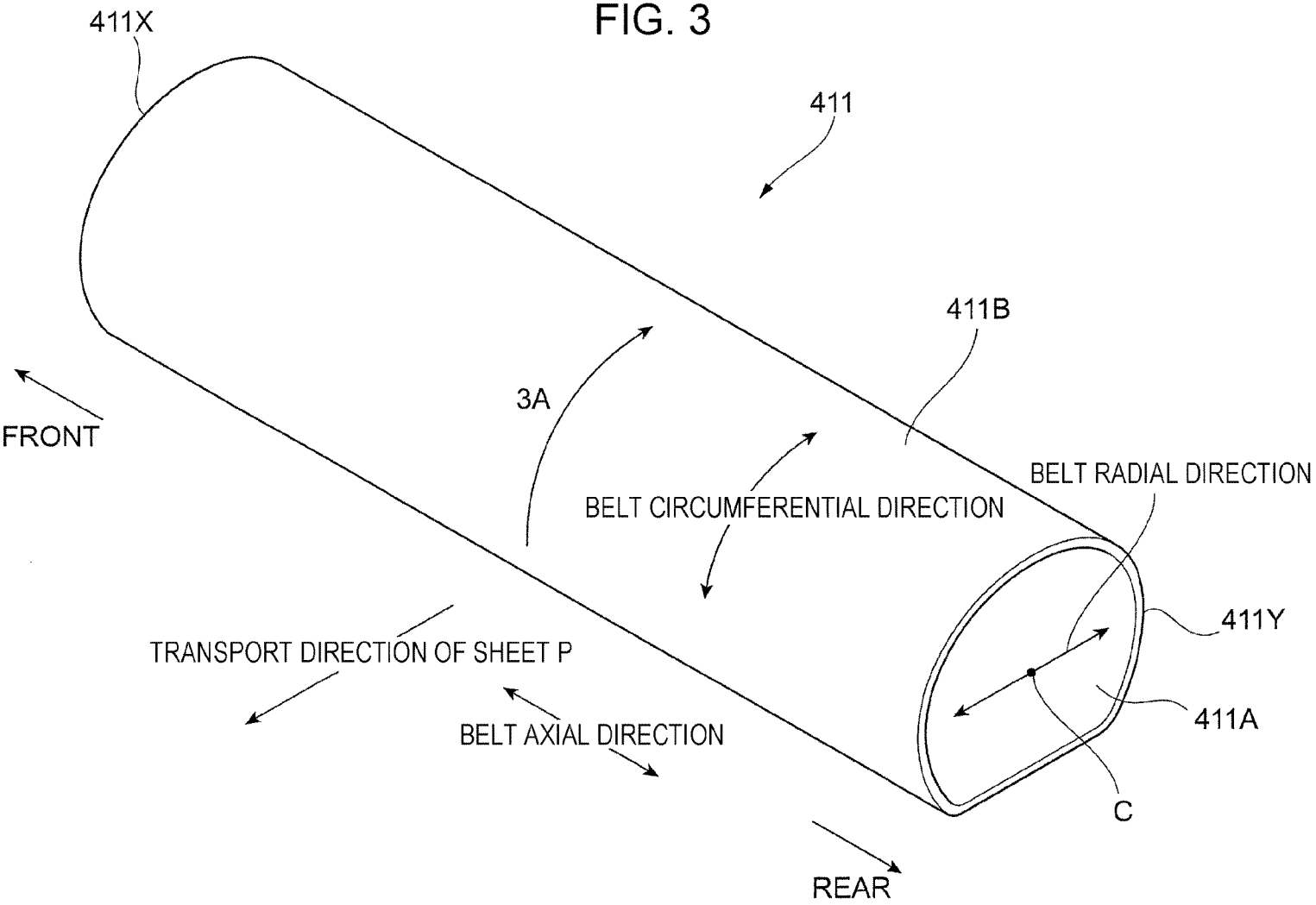
FIG. 3 is a perspective view of a fixing belt viewed in the direction of arrow III of FIG. 2.

FIG. 3 is a perspective view of the fixing belt 411 viewed in the direction of arrow III in FIG. 2. More specifically, FIG. 3 is a perspective view of the fixing belt 411 viewed from the rear side of the image forming apparatus 1.

The fixing belt 411 according to the present exemplary embodiment is endless. The fixing belt 411 rotates in the direction of arrow 3A upon receipt of the driving force from the pressing roller 46 illustrated in FIG. 2.

The fixing belt 411 has a first end portion 411X on one side in the axial direction, and a second end portion 411Y on the other side. The fixing belt 411 also has the outer circumferential surface 411B and the inner circumferential surface 411A.

Figure 4:
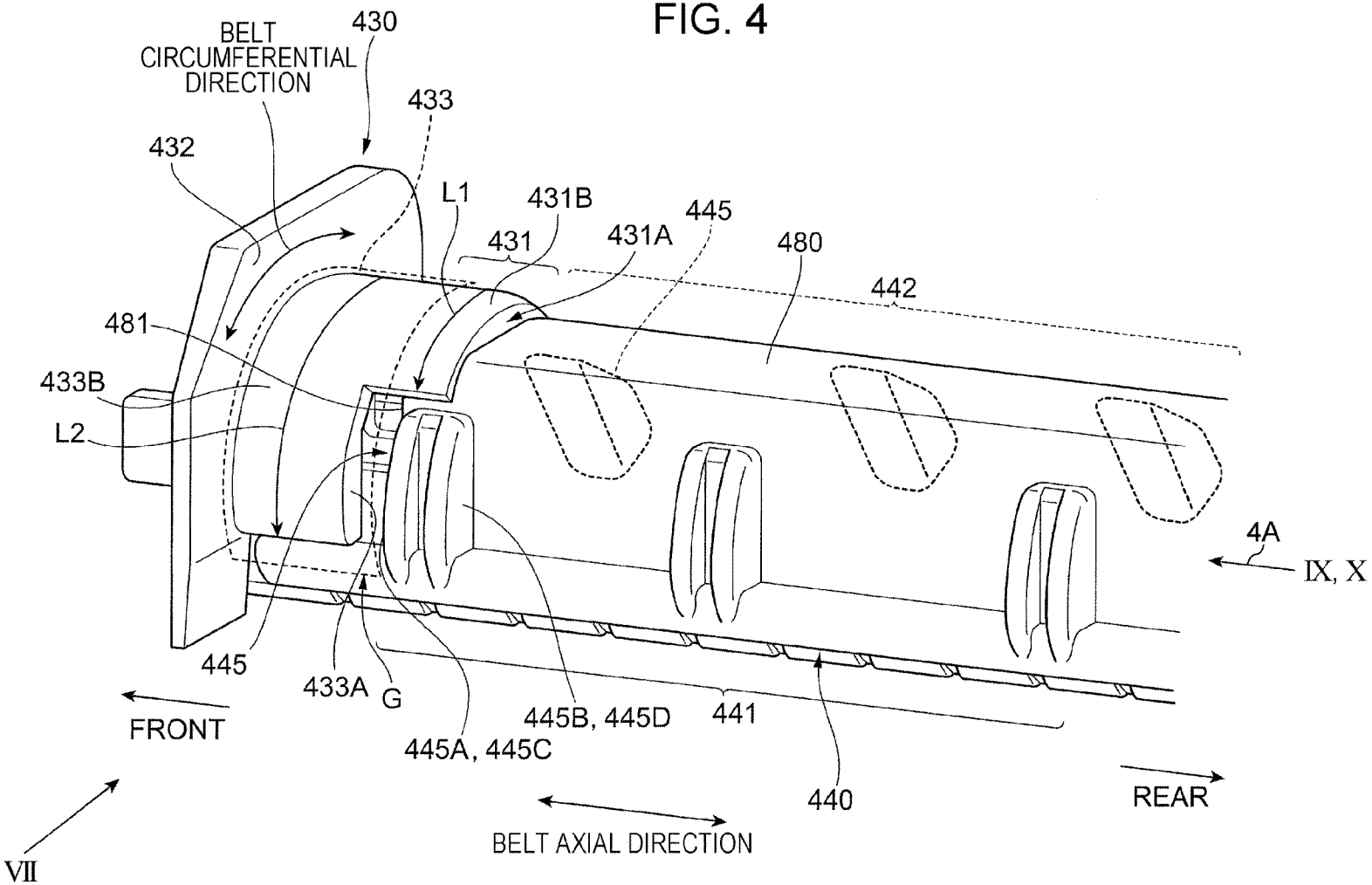
FIG. 4 illustrates an internal structure of a fixing belt.

FIG. 4 illustrates an internal structure of the fixing belt 411. More specifically, FIG. 4 illustrates an internal structure of the fixing belt 411 on the front side of the image forming apparatus 1.

Here, FIG. 4 omits illustration of the fixing belt 411. FIG. 4 illustrates the structure of the fixing belt 411 near the first end portion 411X (see FIG. 3).

Hereinbelow, the structure of the fixing belt 411 near the first end portion 411X is mostly described. However, the structure of the fixing belt 411 near the second end portion 411Y is similar to that near the first end portion 411X. Instead, the portion near the first end portion 411X and the portion near the second end portion 411Y may have different structures.

As illustrated in FIG. 4, the belt support member 440, which supports the inner side of the fixing belt 411, is disposed on the inner side of the fixing belt 411 (not illustrated in FIG. 4).

As described above, the belt support member 440 includes the upstream support assembly 441 and the downstream support assembly 442. Each of the upstream support assembly 441 and the downstream support assembly 442 includes multiple belt supports 445, which are in contact with part of the inner circumferential surface 411A of the fixing belt 411 to support the inner side of the fixing belt 411.

In each of the upstream support assembly 441 and the downstream support assembly 442, multiple belt supports 445 are arranged in the axial direction of the fixing belt 411.

Each belt support 445 includes a first end portion 445A, disposed closer to the first end portion 411X (see FIG. 3) of the fixing belt 411.

Each belt support 445 also includes a second end portion 445B, opposite to the first end portion 445A. In other words, the belt support 445 includes a second end portion 445B, disposed closer to the second end portion 411Y (see FIG. 3) of the fixing belt 411.

More specifically, each belt support 445 is formed of a convex portion extending in the circumferential direction of the fixing belt 411 (see FIG. 3) and protruding toward the inner circumferential surface 411A of the fixing belt 411.

Each belt support 445 includes, as an example of the first end portion 445A, a first side edge 445C extending in the circumferential direction. Each belt support 445 also includes, as an example of the second end portion 445B, a second side edge 445D disposed opposite to the first side edge 445C.

As illustrated in FIG. 4, in the present exemplary embodiment, a support frame 480 is disposed inside the fixing belt 411 (see FIG. 3) between the downstream support assembly 442 and the upstream support assembly 441.

The support frame 480, which is an example of an internal member, is formed by, for example, bending a metal plate. The support frame 480 extends in the axial direction of the fixing belt 411. The support frame 480 includes a frame end portion 481, which is an example of a first end portion, near the first end portion 411X (see FIG. 3) of the fixing belt 411.

The restricting member 430, which restricts the fixing belt 411 from moving in the axial direction, is disposed near the first end portion 411X of the fixing belt 411.

The restricting member 430 includes a stop portion 432, disposed perpendicularly to the axial direction of the fixing belt 411, and against which the first end portion 411X of the fixing belt 411 abuts.

In the present exemplary embodiment, the fixing belt 411 moving in the axial direction has the first end portion 411X abutting against the stop portion 432 to be restricted from moving further.

The restricting member 430 also includes a guide portion 433, which guides the fixing belt 411 moving (rotating) in the circumferential direction.

The guide portion 433 is disposed on the inner side of the fixing belt 411, and in contact with the inner circumferential surface 411A of the fixing belt 411 to guide the fixing belt 411.

The guide portion 433 extends in the circumferential direction of the fixing belt 411. The guide portion 433 also extends in the axial direction of the fixing belt 411, or has a length L3 in the axial direction of the fixing belt 411.

The guide portion 433 is formed into a letter U shape when viewed in the direction of arrow 4A of FIG. 4. In other words, the guide portion 433 has a semicircular cross section. The guide portion 433 protrudes to face the inner circumferential surface 411A of the fixing belt 411.

The guide portion 433 also includes an edge portion 433A, extending in the circumferential direction of the fixing belt 411, located closer to the second end portion 411Y (see FIG. 3) of the fixing belt 411.

The restricting member 430 also includes the protruding portion 431, protruding from the guide portion 433 toward the second end portion 411Y (see FIG. 3) of the fixing belt 411.

The protruding portion 431 refers to a portion protruding from a portion connected to the guide portion 433 toward the second end portion 411Y of the fixing belt 411. The protruding portion 431 has a length L1 (the length of the fixing belt 411 in the circumferential direction), which is smaller than a length L2 (the length of the fixing belt 411 in the circumferential direction) of the guide portion 433.

As in the case of the guide portion 433, the protruding portion 431 has a letter U shape when viewed in the direction of arrow 4A. In other words, the protruding portion 431 has an arc-shaped cross section.

The protruding portion 431 protrudes to face the inner circumferential surface 411A of the fixing belt 411.

In the present exemplary embodiment, the protruding portion 431 is disposed at a position, in the circumferential direction of the fixing belt 411, different from the positions at which the belt supports 445 are disposed.

More specifically, the protruding portion 431 is disposed at a position, in the circumferential direction of the fixing belt 411, different from the positions at which the downstream support assembly 442 and the upstream support assembly 441 are disposed in the circumferential direction.

More specifically, in the movement direction of the fixing belt 411 (the direction of arrow 3A in FIG. 3), the protruding portion 431 is disposed downstream of the upstream support assembly 441, and upstream of the downstream support assembly 442.

More specifically, in the present exemplary embodiment, when projected in the axial direction of the fixing belt 411 (in the direction of arrow 4A in the drawing), the protruding portion 431, the downstream support assembly 442, and the upstream support assembly 441 are located at different positions in the circumferential direction of the fixing belt 411.

Figure 5:
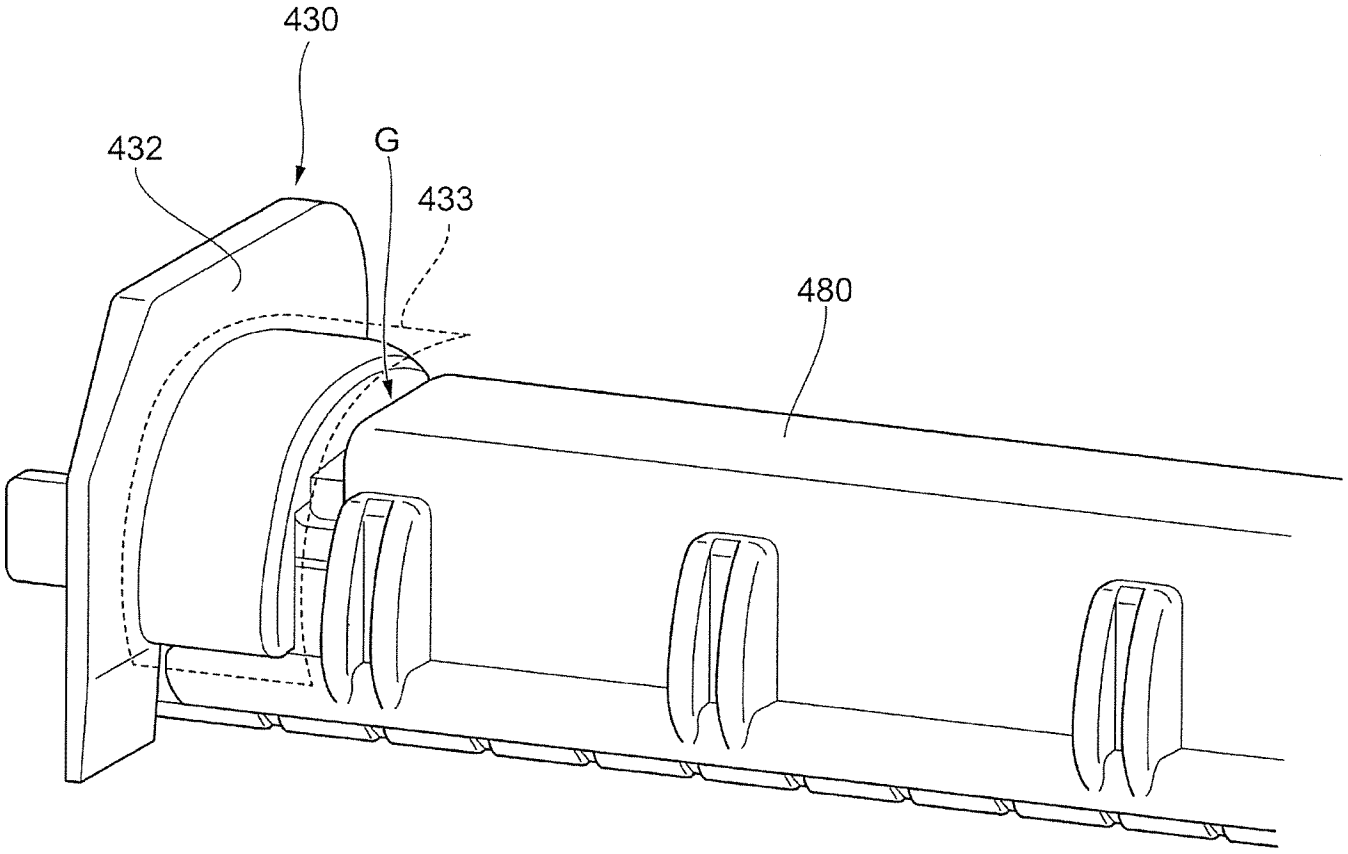
FIG. 5 illustrates a comparative example.

FIG. 5 illustrates a comparative example.

This comparative example does not include the protruding portion 431, and includes a gap G between the guide portion 433 and the support frame 480.

In this comparative example, a portion of the fixing belt 411 (not illustrated in FIG. 5) facing the gap G is not supported.

In this structure, the fixing belt 411 is more likely to be displaced toward the inner side of the fixing belt 411 due to, for example, buckling of the fixing belt 411 when the fixing belt 411 abuts against the stop portion 432 and receives a load exerting in the axial direction.

On the other hand, the protruding portion 431 according to the present exemplary embodiment increases the supported area of the inner side of the fixing belt 411, and is more likely to prevent deformation of the fixing belt 411.

As in the case of the comparative example, as illustrated in FIG. 4, the present exemplary embodiment also has a gap G between the support frame 480 and the guide portion 433, so that the fixing belt 411 may be deformed.

More specifically, in the present exemplary embodiment, the support frame 480 is located closer to the second end portion 411Y (see FIG. 3) of the fixing belt 411 than the edge portion 433A of the guide portion 433 to form a gap G between the support frame 480 and the guide portion 433. This structure allows the fixing belt 411 to be easily deformed.

The present exemplary embodiment, however, includes the protruding portion 431, which protrudes from the guide portion 433 toward the support frame 480 to support the inner side of the fixing belt 411 and prevents the fixing belt 411 from being deformed.

More specifically, in the present exemplary embodiment, as illustrated in FIG. 4, a far end portion 431A of the protruding portion 431 in a protrusion direction, is located closer to the second end portion 411Y (see FIG. 3) of the fixing belt 411 than the frame end portion 481 of the support frame 480 in the axial direction of the fixing belt 411.

Thus, in the present exemplary embodiment, the protruding portion 431 covers the gap G between the guide portion 433 and the support frame 480. Thus, in the present exemplary embodiment, the fixing belt 411 is less likely to be deformed.

Moreover, in the present exemplary embodiment, as illustrated in FIG. 4, the support frame 480 is located closer to a center portion C (see FIG. 3), in the radial direction of the fixing belt 411 (see FIG. 3), than the protruding portion 431.

In the present exemplary embodiment, the protruding portion 431 is supported by the support frame 480, which is an example of a support portion, at a center portion C in the radial direction of the fixing belt 411.

The support frame 480 is disposed at at least a position facing the far end portion 431A of the protruding portion 431. In the present exemplary embodiment, at least the far end portion 431A is supported by the support frame 480.

In other words, in the present exemplary embodiment, at least a free end portion of the protruding portion 431 is supported by the support frame 480. Instead of the far end portion 431A, the base end portion of the protruding portion 431 may be supported, or the far end portion 431A and the base end portion may both be supported.

In the structure where the protruding portion 431 is supported from the center portion C of the fixing belt 411 in the radial direction, the protruding portion 431 is prevented from being bent (distorted) toward the center portion C, and thus the fixing belt 411 is prevented from being deformed.

In the present exemplary embodiment, the guide portion 433 includes an opposing surface 433B, which opposes the inner circumferential surface 411A (see FIG. 3) of the fixing belt 411, and the protruding portion 431 includes an opposing surface 431B, which opposes the inner circumferential surface 411A of the fixing belt 411.

In the present exemplary embodiment, the opposing surface 431B of the protruding portion 431 is located in an extended plane of the opposing surface 433B of the guide portion 433. In other words, in the present exemplary embodiment, the opposing surface 433B of the guide portion 433 and the opposing surface 431B of the protruding portion 431 are flush with each other.

Thus, the opposing surface 433B of the guide portion 433 and the opposing surface 431B of the protruding portion 431 have no level difference between each other, so that the fixing belt 411 is prevented from, for example, being worn by such a level difference.

Figure 6:
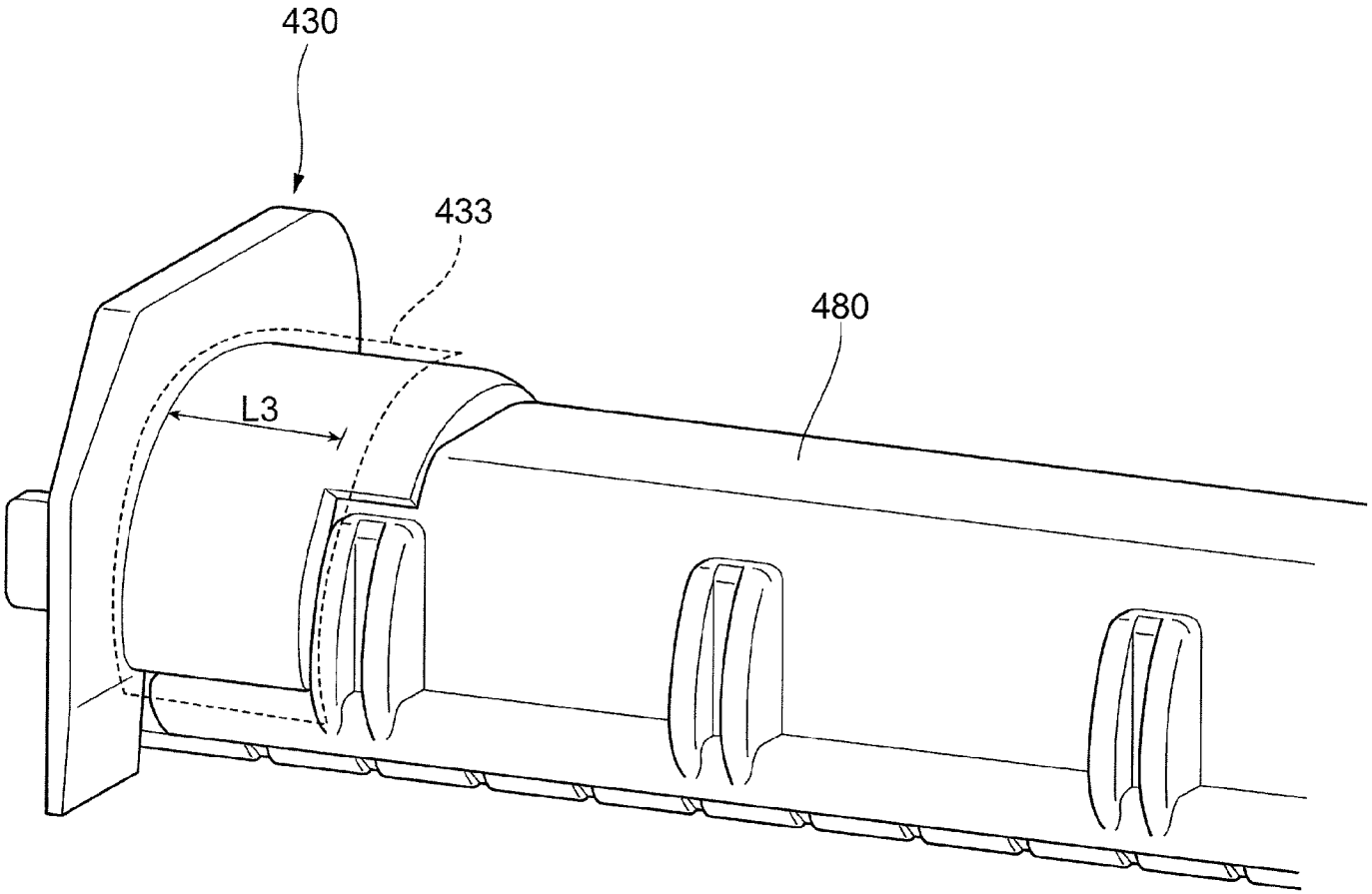
FIG. 6 illustrates another example of the structure of a restricting member.

FIG. 6 illustrates another example of the structure of the restricting member 430.

The structure example illustrated in FIG. 6 has a longer guide portion length L3, which is a length of the guide portion 433 in the axial direction of the fixing belt 411, and a smaller gap G (see FIG. 4) between the guide portion 433 and the support frame 480, than the structure example illustrated in FIG. 4.

This structure has a larger support area over which the inner side of the fixing belt 411 is supported, and is more likely to prevent deformation of the fixing belt 411.

As illustrated in FIG. 4, the gap G disposed between the guide portion 433 and the support frame 480 may be filled with only the protruding portion 431 or with the protruding portion 431 and the extended portion of the guide portion 433, as illustrated in FIG. 6.

Figure 7A:
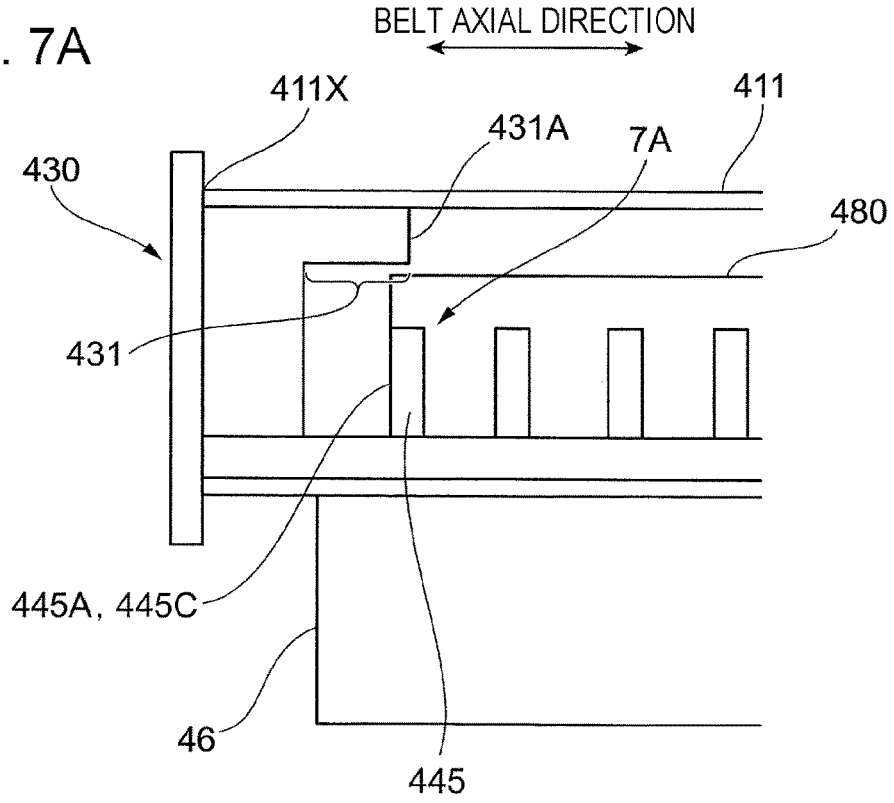
FIGS. 7A and 7B illustrate components including a restricting member illustrated in FIG. 4 viewed in the direction of arrow VII.
Figure 7B:
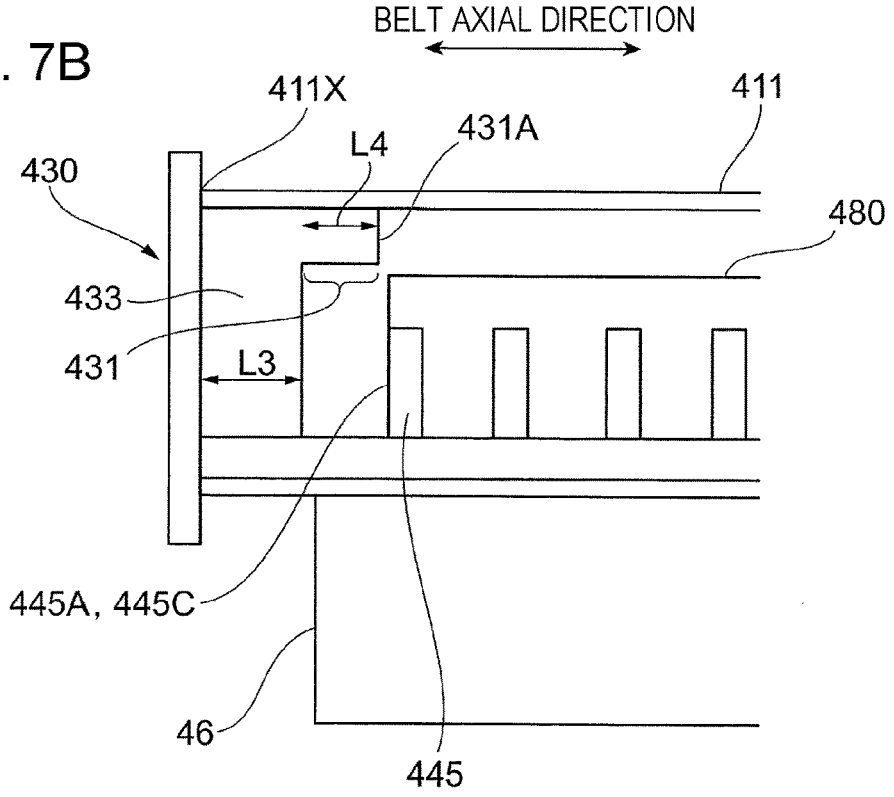

FIGS. 7A and 7B illustrate components including the restricting member 430 viewed in the direction of arrow VII of FIG. 4. FIGS. 7A and 7B illustrate the fixing belt 411.

As illustrated in FIG. 7A, in the present exemplary embodiment, the far end portion 431A of the protruding portion 431 is disposed closer to the second end portion 411Y (see FIG. 3) of the fixing belt 411 than the first end portion 445A of the belt support 445 in the axial direction of the fixing belt 411.

In other words, in the present exemplary embodiment, the far end portion 431A of the protruding portion 431 is located closer to the second end portion 411Y of the fixing belt 411 than the first side edge 445C of the belt support 445.

Here, the leftmost belt support 445, denoted with 7A in the drawing, is the belt support 445 closest to the first end portion 411X of the fixing belt 411.

In the exemplary embodiment, the far end portion 431A of the protruding portion 431 is located closer to the second end portion 411Y of the fixing belt 411 than the first end portion 445A of the belt support 445 located closest to the first end portion 411X.

In this structure, the supported area of the fixing belt 411 is larger than that in the case where the far end portion 431A is located closer to the first end portion 411X of the fixing belt 411 than the first end portion 445A, and thus the fixing belt 411 is more likely to be prevented from being deformed.

As illustrated in FIG. 7B, the far end portion 431A of the protruding portion 431 may be located closer to the first end portion 411X of the fixing belt 411 than the first end portion 445A of the belt support 445 located closest to the first end portion 411X of the fixing belt 411.

Also in this structure, the fixing belt 411 is more likely to be prevented from being deformed compared to the structure including no protruding portion 431 (including only the guide portion 433).

In the structure example illustrated in FIG. 7B, when the lengths of portions of the fixing belt 411 in the axial direction are compared, the guide portion length L3 of the guide portion 433 is different from the protruding portion length L4 of the protruding portion 431. Specifically, in the structure example, the protruding portion length L4 is shorter than the guide portion length L3.

The structure where the protruding portion length L4 is shorter than the guide portion length L3 is capable of preventing an increase of sliding resistance (sliding resistance exerted on the fixing belt 411) due to the existence of the protruding portion 431, compared to the structure where the protruding portion length L4 is larger than the guide portion length L3.

Figure 8A:
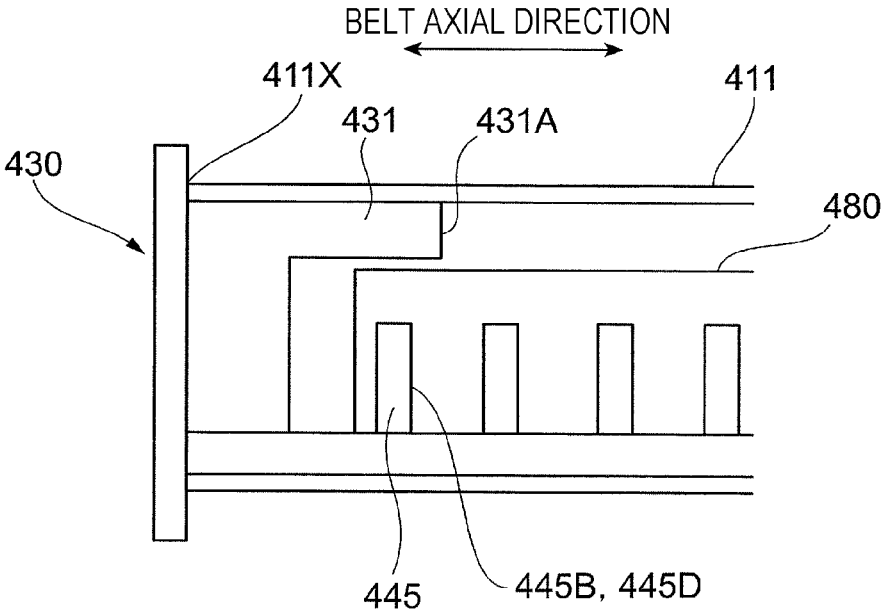
FIGS. 8A and 8B illustrate other structure examples of components including a restricting member.
Figure 8B:
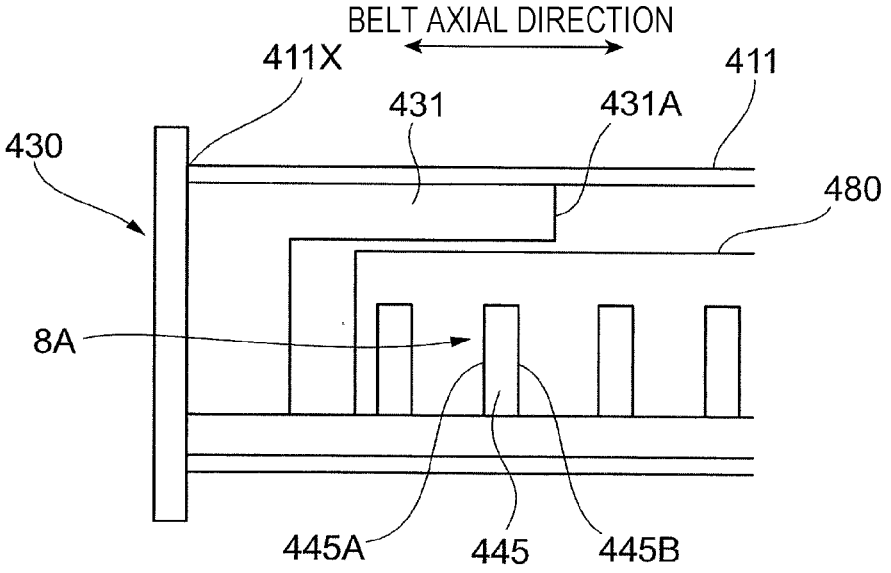

FIGS. 8A and 8B illustrate other structure examples of components including the restricting member 430.

In the structure example illustrated in FIG. 8A, the far end portion 431A of the protruding portion 431 is located closer to the second end portion 411Y of the fixing belt 411 than the second end portion 445B (second side edge 445D) of the belt support 445.

More specifically, in the structure example illustrated in FIG. 8A, the far end portion 431A is located closer to the second end portion 411Y of the fixing belt 411 than the second end portion 445B of the belt support 445 located closest to the first end portion 411X of the fixing belt 411.

Extending the protruding portion 431 beyond the second end portion 445B further increases the support area of the fixing belt 411, and thus the fixing belt 411 is further prevented from being deformed.

As illustrated in FIG. 8B, the far end portion 431A may be located closer to the second end portion 411Y of the fixing belt 411 than the first end portion 445A of the belt support 445 (the belt support 445 denoted with reference sign 8A) located second closest to the first end portion 411X of the fixing belt 411.

In FIG. 8B, the far end portion 431A is located closer to the second end portion 411Y of the fixing belt 411 than the second end portion 445B of the belt support 445 located second closest to the first end portion 411X.

Figure 9:
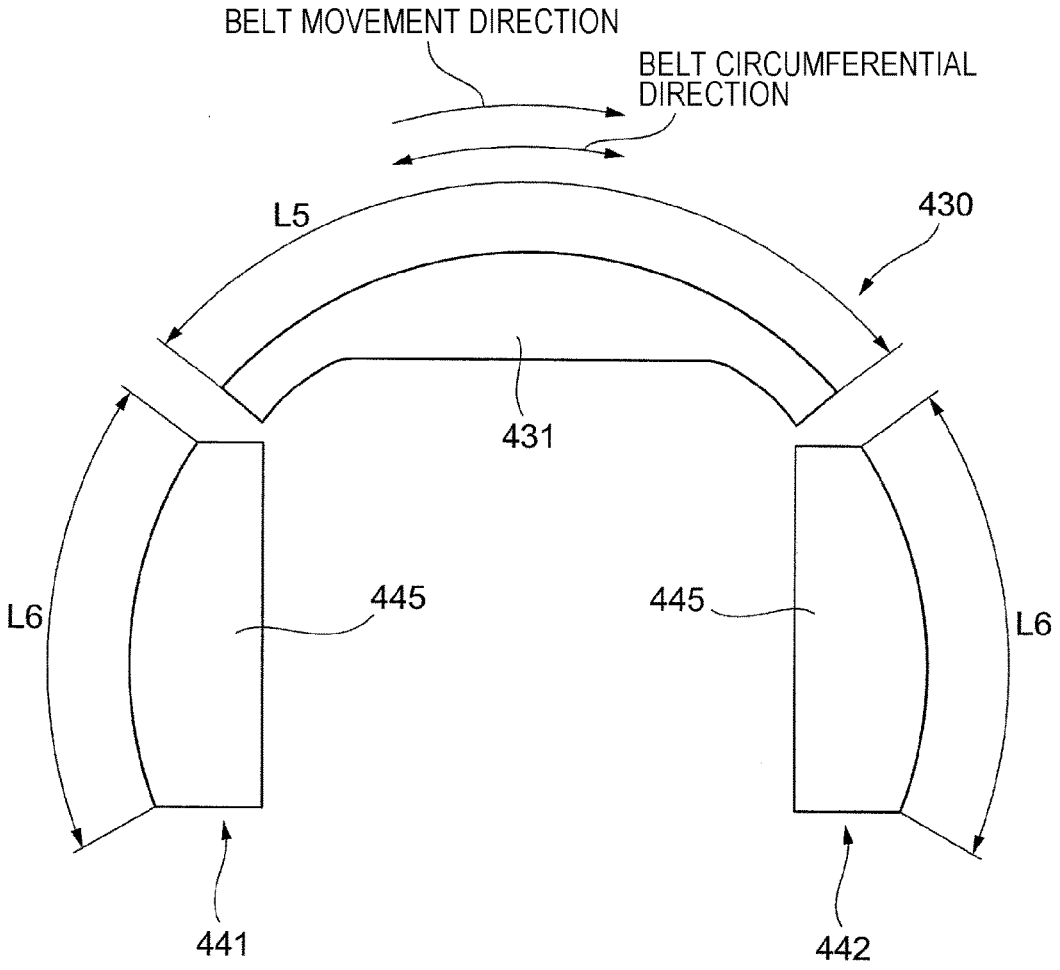
FIG. 9 illustrates belt supports and a protruding portion viewed in the direction of arrow IX of FIG. 4.

FIG. 9 illustrates the belt supports 445 and the protruding portion 431, viewed in the direction of arrow IX of FIG. 4.

In the present exemplary embodiment, each belt support 445 extends in the circumferential direction of the fixing belt 411. Each belt support 445 has a length L6 in the circumferential direction of the fixing belt 411.

In the present exemplary embodiment, the length L5 of the protruding portion 431 in the circumferential direction of the fixing belt 411 is longer than the length L6 of each belt support 445 in the circumferential direction of the fixing belt 411.

In this structure, compared to the structure where the length L5 of the protruding portion 431 is shorter than the length L6 of the belt support 445 (the structure where the length L5 of the protruding portion 431 is short and the gap between the protruding portion 431 and each belt support 445 is large), the support area of the fixing belt 411 in the circumferential direction of the fixing belt 411 increases, and thus the fixing belt 411 is further prevented from being deformed.

As illustrated in FIG. 9, in the present exemplary embodiment, the protruding portion 431 is disposed between, in the circumferential direction of the fixing belt 411, one belt support 445 of the upstream support assembly 441 and one belt support 445 of the downstream support assembly 442.

Specifically, in the present exemplary embodiment, the protruding portion 431 is disposed downstream of the upstream support assembly 441, and upstream of the downstream support assembly 442 in the movement direction of the fixing belt 411.

The fixing belt 411 is more likely to be depressed inward in the radial direction of the fixing belt 411 between the upstream support assembly 441 and the downstream support assembly 442. However, the protruding portion 431 between these assemblies prevents the fixing belt 411 from being deformed.

Figure 10:
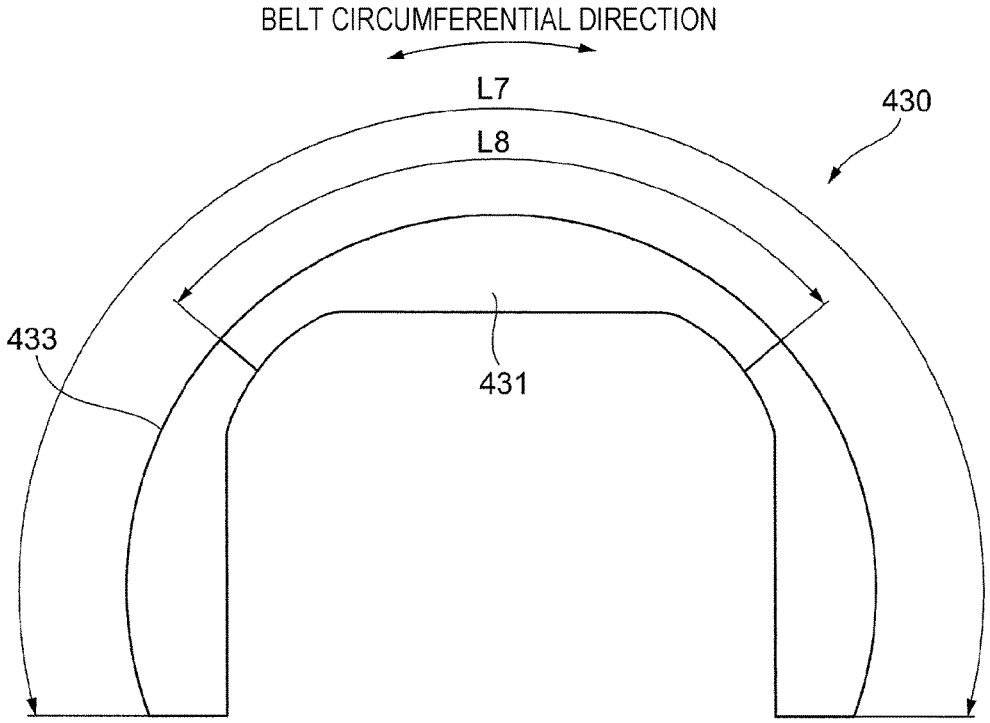
FIG. 10 illustrates the restricting member viewed in the direction of arrow X of FIG. 4.

FIG. 10 illustrates the restricting member 430, viewed in the direction of arrow X in FIG. 4. FIG. 10 omits illustration of the stop portion 432.

In the present exemplary embodiment, the guide portion 433 extends in the circumferential direction of the fixing belt 411, and has a length L7 in the circumferential direction of the fixing belt 411.

The protruding portion 431 also extends in the circumferential direction of the fixing belt 411, and has a length L8 in the circumferential direction of the fixing belt 411.

In the present exemplary embodiment, the difference obtained by subtracting the length L8 of the protruding portion 431 in the circumferential direction from the length L7 of the guide portion 433 in the circumferential direction is longer than the length L8 of the protruding portion 431 in the circumferential direction.

In other words, in the present exemplary embodiment, compared to the case where the difference is smaller than the length L8 of the protruding portion 431 in the circumferential direction, the length of the protruding portion 431 relative to the guide portion 433 is shorter.

In this structure, sliding resistance (sliding resistance exerted on the fixing belt 411) attributable to the existence of the protruding portion 431 is prevented from increasing, compared to the case where the length of the protruding portion 431 relative to that of the guide portion 433 is longer.

Figure 11A:
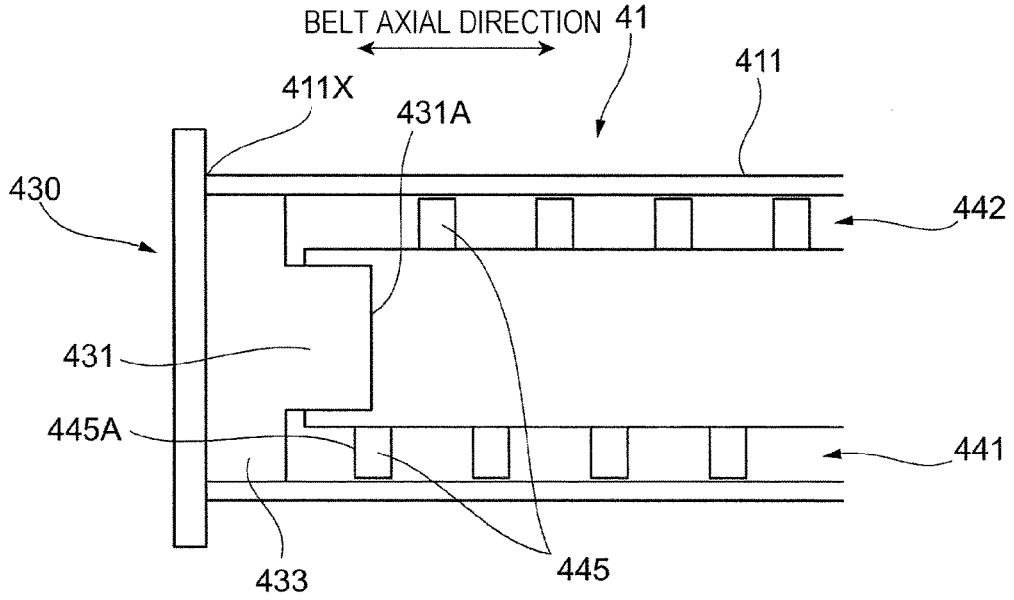
FIGS. 11A and 11B illustrate other examples of the internal structure of a fixing belt module, viewed from above.
Figure 11B:
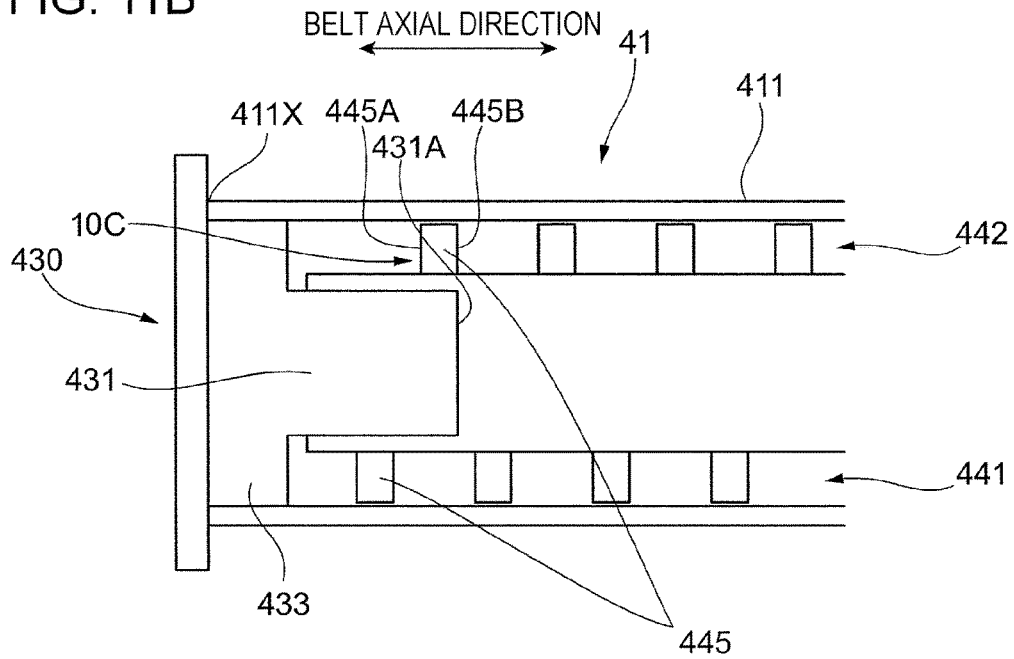

FIGS. 11A and 11B illustrate other examples of the internal structure of the fixing belt module 41, when viewed from above.

As illustrated in FIG. 11A, in this structure example, the belt supports 445 of the upstream support assembly 441 and the belt supports 445 of the downstream support assembly 442 are arranged in a staggered manner.

In other words, in this structure example, when the positions of the fixing belt 411 in the axial direction are compared, the belt supports 445 of the upstream support assembly 441 and the belt supports 445 of the downstream support assembly 442 are positioned at different positions.

More specifically, in the axial direction of the fixing belt 411, each belt support 445 of the downstream support assembly 442 is located between adjacent two of the belt supports 445 of the upstream support assembly 441.

Specifically, in this structure example, when projected in the direction perpendicular to the axial direction of the fixing belt 411, the belt supports 445 of the upstream support assembly 441 and the belt supports 445 of the downstream support assembly 442 are arranged alternately with each other.

Also in the structure example illustrated in FIG. 11A, the far end portion 431A of the protruding portion 431 is located closer to the second end portion 411Y (see FIG. 3) of the fixing belt 411 than the first end portion 445A of the belt support 445 located closest to the first end portion 411X of the fixing belt 411.

As in the above case, compared to the structure where the far end portion 431A of the protruding portion 431 is not located closer to the second end portion 411Y of the fixing belt 411 than the first end portion 445A, the support area of the fixing belt 411 increases further and the fixing belt 411 is less likely to be deformed.

As illustrated in FIG. 11B, the far end portion 431A of the protruding portion 431 may be located closer to the second end portion 411Y of the fixing belt 411 than the first end portion 445A of the belt support 445 located second closest to the first end portion 411X of the fixing belt 411 (belt support 445 denoted with the reference sign 10C).

Although not illustrated, the far end portion 431A of the protruding portion 431 may be located closer to the second end portion 411Y of the fixing belt 411 than the second end portion 445B of the belt support 445 located second closest to the first end portion 411X.

As in the above case, the structure example illustrated in FIG. 11A prevents the fixing belt 411 from being deformed while preventing the sliding resistance (sliding resistance exerted on the fixing belt 411) from increasing.

The structure example illustrated in FIG. 11B further prevents the fixing belt 411 from being deformed, although the sliding resistance increases compared to the structure example illustrated in FIG. 11A.

Here, the belt supports 445 of the upstream support assembly 441 and the belt supports 445 of the downstream support assembly 442 may be arranged at the same position in the axial direction of the fixing belt 411, as illustrated in FIG. 4 and other drawings, or may be staggered as illustrated in FIGS. 11A and 11B.

In either case, the fixing belt 411 is less likely to be deformed as long as the far end portion 431A of the protruding portion 431 is located closer to the second end portion 411Y of the fixing belt 411 than the first end portion 445A of the belt support 445 located closest or second closest to the first end portion 411X of the fixing belt 411.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

an endless belt member that rotates, and includes a first end on one side in an axial direction and a second end on the other side in the axial direction;

a belt support that comes into contact with part of an inner circumferential surface of the belt member to support an inner side of the belt member;

a guide portion disposed on the inner side of the belt member at at least one of the first and second ends of the belt member to guide the belt member moving in a circumferential direction;

a protruding portion disposed at a position in the circumferential direction of the belt member different from a position in the circumferential direction at which the belt support is disposed, the protruding portion protruding from the guide portion toward the other one of the first and second ends of the belt member; and a support portion disposed on the inner side of the belt member at a position closer to a radial center portion of the belt member than the protruding portion to support the protruding portion from the center portion.

2. The fixing device according to claim 1, wherein the belt support includes a first end portion located closer to the one of the first and second ends of the belt member, wherein a far end portion of the protruding portion in a protrusion direction is located closer to the other one of the first and second ends of the belt member than the first end portion of the belt support in the axial direction of the belt member.

3. The fixing device according to claim 2, wherein the belt support includes a second end portion, opposite to the first end portion, and wherein the far end portion is located closer to the other one of the first and second ends of the belt member than the second end portion of the belt support in the axial direction of the belt member.

4. The fixing device according to claim 2, wherein the belt support includes a convex portion disposed to extend in the circumferential direction and to protrude toward the inner circumferential surface of the belt member, the belt support including a first side edge serving as the first end portion of the belt support and extending in the circumferential direction of the belt member, and wherein the far end portion is located closer to the other one of the first and second ends of the belt member than the first side edge of the belt support in the axial direction of the belt member.

5. The fixing device according to claim 3, wherein the belt support includes a convex portion disposed to extend in the circumferential direction and to protrude toward the inner circumferential surface of the belt member, the belt support including a first side edge and a second side edge, the first side edge serving as the first end portion of the belt support and extending in the circumferential direction of the belt member, the second side edge serving as the second end portion of the belt support and located opposite to the first side edge, wherein the far end portion is located closer to the other one of the first and second ends of the belt member than the second side edge of the belt support in the axial direction of the belt member.

6. The fixing device according to claim 2, wherein an upstream support assembly and a downstream support assembly are disposed on the inner side of the belt member, the upstream support assembly including a plurality of the belt supports arranged in the axial direction of the belt member, the downstream support assembly including a plurality of the belt supports arranged in the axial direction of the belt member, the downstream support assembly being disposed downstream of the upstream support assembly in a direction in which the belt member moves, wherein the belt supports of the upstream support assembly and the belt supports of the downstream support assembly are arranged in a staggered manner, and wherein the far end portion of the protruding portion is located closer to the other one of the first and second ends of the belt member than the first end portion of the belt support located closest to the one of the first and second ends of the belt member.

7. The fixing device according to claim 6, wherein the far end portion of the protruding portion is located closer to the other one of the first and second ends of the belt member than the first end portion of the belt support located second closest to the one of the first and second ends of the belt member.

8. The fixing device according to claim 1, wherein the belt support extends in the circumferential direction of the belt member, and the protruding portion has a length in the circumferential direction, and wherein the length of the protruding portion in the circumferential direction is longer than a length of the belt support in the circumferential direction.

9. The fixing device according to claim 1, wherein the protruding portion has a length in the circumferential direction of the belt member, and wherein a difference obtained by subtracting the length of the protruding portion in the circumferential direction from a length of the guide portion in the circumferential direction is longer than the length of the protruding portion in the circumferential direction.

10. A fixing device comprising:

an endless belt member that rotates, and includes a first end on one side in an axial direction and a second end on the other side in the axial direction;

a belt support that comes into contact with part of an inner circumferential surface of the belt member to support an inner side of the belt member;

a guide portion disposed on the inner side of the belt member at at least one of the first and second ends of the belt member to guide the belt member moving in a circumferential direction; and a protruding portion disposed at a position in the circumferential direction of the belt member different from a position in the circumferential direction at which the belt support is disposed, the protruding portion protruding from the guide portion toward the other one of the first and second ends of the belt member, wherein an internal member is disposed on the inner side of the belt member, the internal member being disposed closer to the other one of the first and second ends of the belt member than the guide portion with a gap interposed between the internal member and the guide portion, wherein the internal member includes a first end portion located closer to the one of the first and second ends of the belt member, and wherein, in the axial direction of the belt member, a far end portion of the protruding portion in a protrusion direction is located closer to the other one of the first and second ends of the belt member than the first end portion of the internal member.

11. The fixing device according to claim 10, wherein the internal member is a support frame disposed in the axial direction of the belt member to support a component disposed on the inner side of the belt member, wherein the support frame includes a frame end portion, serving as the first end portion and disposed closer to the one of the first and second ends of the belt member, and wherein, in the axial direction of the belt member, the far end portion is located closer to the other one of the first and second ends of the belt member than the frame end portion.

12. The fixing device according to claim 1, wherein a protruding portion length, which is a length of the protruding portion in the axial direction of the belt member, is shorter than a guide portion length, which is a length of the guide portion in the axial direction.

13. The fixing device according to claim 1, wherein the support portion supports at least a far end portion of the protruding portion in a protrusion direction.

14. The fixing device according to claim 1, wherein each of the guide portion and the protruding portion includes an opposing surface that faces the inner circumferential surface of the belt member, and wherein the opposing surface of the protruding portion is located in an extended plane of the opposing surface of the guide portion.

15. An image forming apparatus, comprising:

an image forming member that forms an image on a recording medium; and a fixing device that fixes the image formed on the recording medium by the image forming member to the recording medium, wherein the fixing device is the fixing device according to claim 1.

16. A fixing device comprising:

an endless belt member that rotates, and includes a first end on one side in an axial direction and a second end on the other side in the axial direction;

belt support means for coming into contact with part of an inner circumferential surface of the belt member to support an inner side of the belt member;

guide means for guiding the belt member moving in a circumferential direction, the guide means being disposed on the inner side of the belt member at at least one of the first and second ends of the belt member;

a protruding portion disposed at a position in the circumferential direction of the belt member different from a position in the circumferential direction at which the belt support means is disposed, the protruding portion protruding from the guide means toward the other one of the first and second ends of the belt member; and a support portion disposed on the inner side of the belt member at a position closer to a radial center portion of the belt member than the protruding portion to support the protruding portion from the center portion.

* * * * *